US008334811B2

(12) United States Patent
Toor et al.

(10) Patent No.: US 8,334,811 B2
(45) Date of Patent: Dec. 18, 2012

(54) WIRELESS COMMUNICATION ENABLED ELECTRONIC DEVICE

(75) Inventors: Jagdeep S. Toor, Redmond, WA (US); David W. Russo, Woodinville, WA (US)

(73) Assignee: Microsoft Corporation, Redmond, WA (US)

( * ) Notice: Subject to any disclaimer, the term of this patent is extended or adjusted under 35 U.S.C. 154(b) by 474 days.

(21) Appl. No.: 12/482,588

(22) Filed: Jun. 11, 2009

(65) Prior Publication Data

US 2010/0315296 A1 Dec. 16, 2010

(51) Int. Cl.
*H01Q 1/24* (2006.01)

(52) U.S. Cl. ..... 343/702; 343/700 MS

(58) Field of Classification Search ..... 343/700 MS, 343/702, 872, 841
See application file for complete search history.

(56) References Cited

U.S. PATENT DOCUMENTS

| | | | | |
|---|---|---|---|---|
| 3,717,876 | A | 2/1973 | Volkers et al. | |
| 4,370,659 | A | 1/1983 | Chu et al. | |
| 6,061,024 | A * | 5/2000 | McGirr et al. | 343/700 MS |
| 6,417,817 | B1 * | 7/2002 | Pirila et al. | 343/841 |
| 6,778,145 | B2 | 8/2004 | Toland et al. | |
| 6,879,293 | B2 * | 4/2005 | Sato | 343/702 |
| 7,088,306 | B2 | 8/2006 | Chiang et al. | |
| 7,212,161 | B2 | 5/2007 | Chen et al | |
| 7,443,350 | B2 | 10/2008 | Gaucher et al. | |
| 2003/0210191 | A1 | 11/2003 | Mohammadian et al. | |
| 2006/0244663 | A1 * | 11/2006 | Fleck et al. | 343/700 MS |
| 2008/0303722 | A1 * | 12/2008 | Feltz et al. | 343/700 MS |

FOREIGN PATENT DOCUMENTS

WO 2007144382 A1 12/2007

OTHER PUBLICATIONS

Qing, et al., "Parametric Study of Ultra-Wideband Dual Elliptically Tapered Antipodal Slot Antenna", Retrieved at <<www.hindawi.com/GetPDF.aspx?doi=10.1155/2008/267197>>, International Journal of Antennas and Propagation, vol. 2008, Article ID 267197, pp. 12.

* cited by examiner

*Primary Examiner* — Hoanganh Le
(74) *Attorney, Agent, or Firm* — Alleman Hall McCoy Russell & Tuttle LLP

(57) ABSTRACT

A wireless communication enabled electronic device. The wireless communication enabled electronic device includes a wireless antenna having an antenna element, and a conductive enclosure configured to inhibit electrical interference. The conductive enclosure is coupled to the wireless antenna such that a void is formed on at least one side of the antenna element. The void is bound by a sidewall of the conductive enclosure having a bottom edge, and at least one taper portion of the conductive enclosure positioned vertically intermediate a top surface of the conductive enclosure and the bottom edge of the sidewall.

20 Claims, 2 Drawing Sheets

Fig. 1
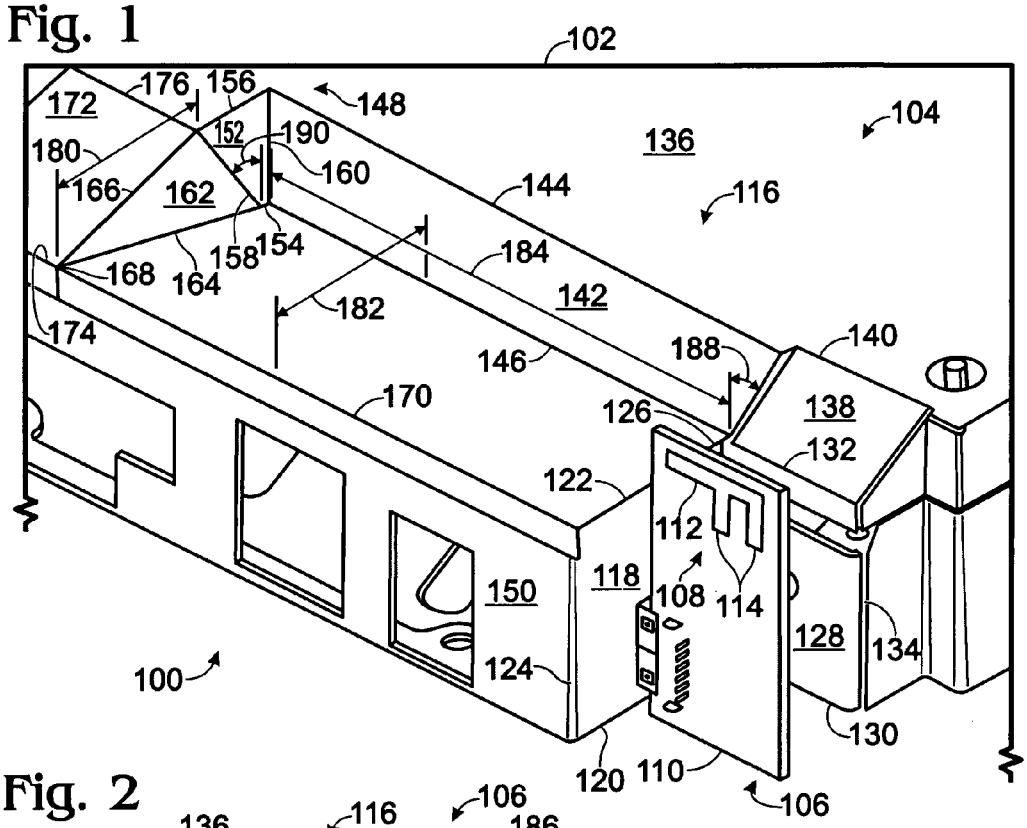
Fig. 2
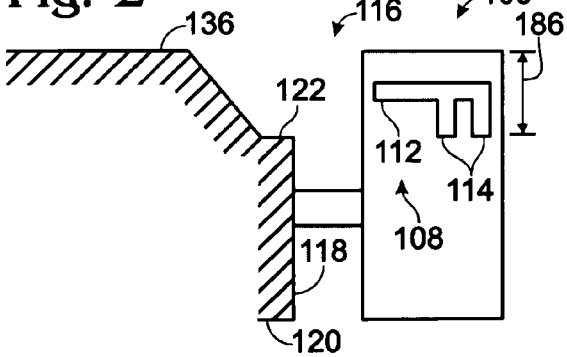
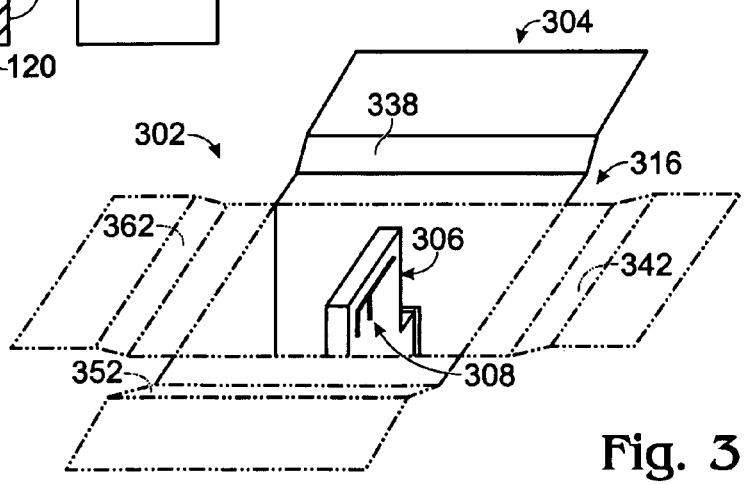
Fig. 3

WIRELESS COMMUNICATION ENABLED ELECTRONIC DEVICE

BACKGROUND

With improvements to wireless communication technology, many different types of electronic devices are incorporating embedded components that enable wireless communication, such as a wireless antenna that enables WIFI connectivity, for example. Some electronic devices may include components that may interfere with wireless communications in some directions. When such electronic devices are used in settings where wireless signals may vary relative to the position of the electronic device, in some cases, the components of the electronic device may interfere with the wireless signals by reducing the signal levels which may result in reduced or intermittent levels of signal coverage. As a result, the strength and fidelity of the wireless connection may suffer, thereby frustrating users.

SUMMARY

A wireless communication enabled electronic device is disclosed. The wireless communication enabled electronic device includes a wireless antenna having an antenna element, and a conductive enclosure configured to inhibit electrical interference. The conductive enclosure is coupled to the wireless antenna such that a void is formed on at least one side of the antenna element. The void is bound by a sidewall of the conductive enclosure having a bottom edge, and at least one taper portion of the conductive enclosure positioned vertically intermediate a top surface of the conductive enclosure and the bottom edge of the sidewall.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE DRAWINGS

FIG. 1 is partial perspective view of a schematic diagram of an embodiment of a conductive enclosure wireless antenna interface of a wireless communication enabled electronic device of the present disclosure.

FIG. 2 is a left side view of the conductive enclosure wireless antenna interface of FIG. 1.

FIG. 3 is a partial perspective view of another embodiment of a conductive enclosure wireless antenna interface of a wireless communication enabled electronic device of the present disclosure.

DETAILED DESCRIPTION

Figure 4:
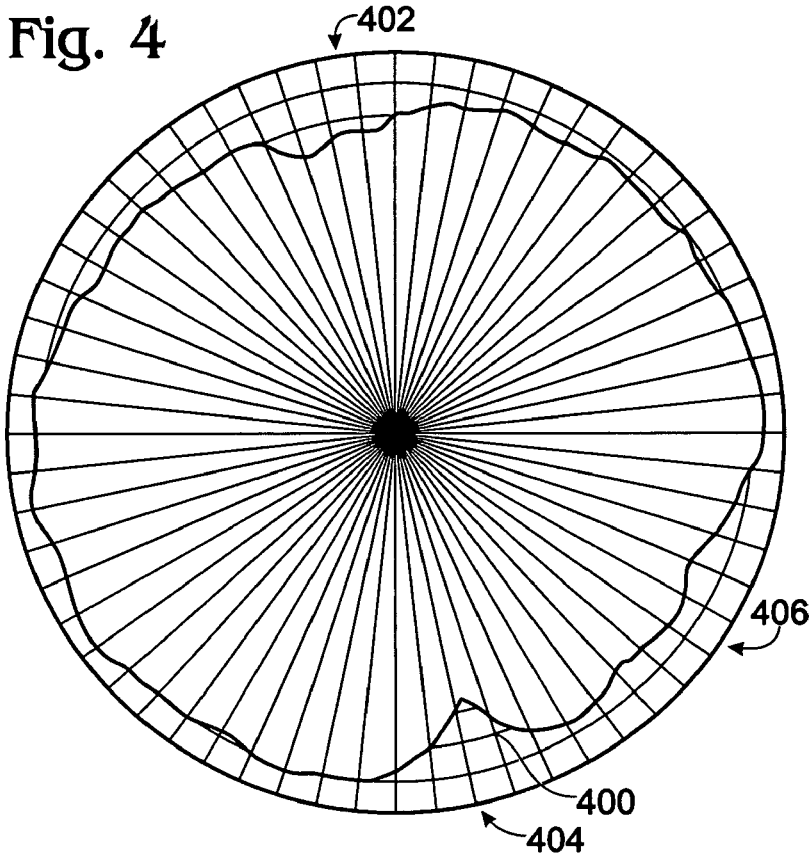
FIG. 4 is a 360 degree signal graph of a wireless communication enabled electronic device that includes a conductive enclosure without taper portions.

The present disclosure relates to forming a conductive enclosure of a wireless communication enabled electronic device so as to reduce signal interference with a wireless antenna embedded in the electronic device. More particularly, a conductive enclosure may include at least one taper portion that at least partially bounds a void proximate the wireless antenna. The void may allow signals to be sent/received via the wireless antenna that would otherwise be blocked by the conductive enclosure. Moreover, the sloping nature of the taper portion(s) may reduce the amount of destructive signal reflections caused by the conductive enclosure, which may result in increased signal strength relative to a wireless communication enabled electronic device having a conductive enclosure without a void and/or taper portion(s). Further still, the void and/or taper portions may enable the wireless antenna to be located closer to the conductive enclosure while maintaining suitable wireless signal strength than would be possible in an implementation in which the conductive enclosure does not include a void and/or taper portions. Accordingly, the size of the electronic device housing may be reduced and/or may be made more streamlined.

FIG. 1 is a partial perspective view of an embodiment of an electronic device 100. The electronic device 100 may comprise a conductive enclosure 104. The conductive enclosure 104 may be a Faraday cage that may be formed by a conductive material that may be configured to inhibit electrical interference. In other words, the Faraday cage may be configured to block out external static electrical fields. Further, the Faraday cage may be configured to prevent electrical charges generated within the Faraday cage from being released from inside the electronic device. In particular, the Faraday cage may cause electrical charges to be redistributed so as to cancel the effects of an electrical field in an interior of the Faraday cage. Thus, the Faraday cage may protect electronic components within the Faraday cage from various electrostatic discharges.

It will be appreciated that the Faraday cage is but one implementation of a conductive enclosure, and that virtually any suitable shape of conductive enclosure may be implemented in the electronic device. The electronic device 100 may embody virtually any suitable type of electronic device that has wireless communication capabilities. For example, the electronic device may include a computing device such as a desktop or laptop computing device, a mobile computing device, an embedded computing device, a game console, etc.

More particularly, FIG. 1 shows a conductive enclosure wireless antenna interface 102. The conductive enclosure 104 may be coupled to a wireless antenna 106 such that the wireless antenna is located outside of conductive enclosure 104. The wireless antenna 106 may be in electronic communication with electronic components held within conductive enclosure 104.

The wireless antenna 106 may include an antenna element 108 formed in a printed circuit board (PCB) 110. The antenna element 108 may be formed in PCB 110 such that the antenna element is a planar antenna element. That is, the planar antenna element may be situated in a plane of the PCB. In the illustrated embodiment, the antenna element is an inverted-F antenna element that includes a spine portion 112 and two branch portions 114. The spine portion 112 may be oriented horizontally and the two branch portions 114 may extend downward from spine portion 112. The PCB 110 may be oriented vertically to position antenna element 108 at a top region of wireless antenna 106 in order to reduce the surface area of conductive enclosure 104 that may interfere with wireless communication. The wireless antenna 106 may be coupled to a first sidewall 118 of conductive enclosure 104 such that the wireless antenna is substantially aligned with the conductive enclosure so that the wireless antenna does not substantially protrude above a top surface 136 of the conductive enclosure. Further, the conductive enclosure 104 may form a cutout region in which wireless antenna 106 may be located so that the wireless antenna does not substantially protrude beyond the outermost walls of the conductive enclosure. This may enable the size of a housing (not shown) of electronic device 100 to be reduced.

The wireless antenna 106 may embody virtually any suitable type of wireless antenna that is capable of radio communication (e.g., WIFI). Further, the antenna element 108 may embody virtually any suitable type of wireless element that boosts wireless signal strength. For example, the antenna element may include a monopole antenna element, a dipole antenna element, a meandering antenna element, a metal-plate antenna element, a slot antenna element, a ceramic chip antenna element, non-inverted F-shaped element, an inverted L-shaped element, a non-inverted L-shaped element, a spiral element, etc. Moreover, in some embodiments, the antenna element may include 3D structures that are not planar. For example, the antenna element may include an off stamped metal antenna element, a bent wire antenna element, a 3D (or non-planar) inverted-F antenna element, etc.

The conductive enclosure 104 may be coupled to wireless antenna 106 such that a void 116 is formed on at least one side of antenna element 108. In the illustrated embodiment, the void 116 is positioned between and bound by wireless antenna 106 and the cutout region of conductive enclosure 104. In particular, conductive enclosure 104 may include first sidewall 118 and a second sidewall 128. The first sidewall 118 may include a bottom edge 120, a top edge 122, an outermost edge 124, and an inner edge 126. The second sidewall 128 may include a bottom edge 130, a top edge 132, an outer edge 134, and an inner edge 126. The first sidewall 118 and the second sidewall 128 may be adjoining, and thus may share inner edge 126. Further, the void 116 may be bound by at least one taper portion positioned vertically intermediate top surface 136 of conductive enclosure 104 and bottom edge 120 of first sidewall 118 and/or bottom edge 130 of second sidewall 128.

In the illustrated embodiment, a first taper portion 138 may be positioned vertically intermediate top surface 136 of conductive enclosure 104 and bottom edge 130 of second sidewall 128. The first taper portion 138 may include a top edge 140 that extends along a portion of top surface 136. The first taper portion 138 may include a bottom edge 132 that is also the top edge of second sidewall 128. The top edge 140 and bottom edge 132 of first taper portion 138 may be oriented perpendicular to top edge 122 of first sidewall 118. Further, the top edge 140 and bottom edge 132 of first taper portion 138 may be oriented parallel to a long edge of spine portion 112 of inverted-F antenna element 108. The first taper portion 138 may extend substantially along a length of the long edge of spine portion 112 of inverted-F antenna element 108. The first taper portion 138 may slope away from a broad face of PCB 110 such that bottom edge 132 is closer to wireless antenna 106 than top edge 140. The slope of first taper portion 138 may reduce or inhibit interference of wireless signals directed in a substantially perpendicularly aligned direction toward conductive enclosure 104.

A second taper portion 142 may be positioned vertically intermediate top surface 136 of conductive enclosure 104 and bottom edge 120 of first sidewall 118. The second taper portion 142 may include a top edge 144 that extends along a portion of top surface 136. The second taper portion 142 may include a bottom edge 146. In some embodiments, the bottom edge 146 of second taper portion 142 may extend a distance 184 that is substantially 380 millimeters from top edge 122 of first sidewall 118 to an inner edge 160 of the second taper portion. This dimension may apply to implementations where the wireless antenna signal is in the 2.4 GHz frequency band. It will be appreciated that other dimensions may be formed in implementations where another signal frequency band is used. The top edge 144 and bottom edge 146 of second taper portion 142 may extend perpendicular to top edge 122 of first sidewall 118 and parallel to the long edge of spine portion 112 of inverted-F antenna element 108. The second taper portion 142 may slope away from a broad face of PCB 110 such that bottom edge 146 is closer to the broad face of PCB 110 than top edge 144. The second taper portion 142 may be offset from wireless antenna 106 towards conductive enclosure 104 to reduce or inhibit interference of wireless signals directed in that substantially offset direction toward conductive enclosure 104.

A projection 148 may extend laterally from second taper portion 142 to outermost edge 124 of first sidewall 118. The outermost edge 124 of first sidewall 118 may be incorporated into an outermost sidewall 150 of conductive enclosure 104, and projection 148 may extend from second taper portion 142 to outermost sidewall 150. The projection 148 may include a third taper portion 152, a fourth taper portion 162, and a fifth taper portion 172. Each of third taper portion 152, fourth taper portion 162, and fifth taper portion 172 may slope in a different direction to reduce signal interference in those different directions.

The third taper portion 152 may be positioned vertically intermediate top surface 136 of conductive enclosure 104 and bottom edge 120 of first sidewall 118. The third taper portion 152 may include a bottom edge 154, a top edge 156, an outer edge 158, and an inner edge 160. The top edge 156 of third taper portion 152 may extend along a portion of top surface 136. The inner edge 160 of third taper portion 152 also may be the inner edge of second taper portion 142. The top edge 156 of third taper portion 152 may extend perpendicular to the long edge of spine portion 112 of antenna element 108. In some embodiments, the bottom edge 154 of third taper portion 152 may come to a point (or may span a short distance). The third taper portion 152 may slope away from a narrow face of PCB 110 such that bottom edge 154 is closer to the narrow face of PCB 110 than top edge 156.

The fourth taper portion 162 may be positioned vertically intermediate top surface 136 of conductive enclosure 104 and bottom edge 120 of first sidewall 118. The fourth taper portion 162 may include a bottom edge 164, a top edge 166, an outer edge 168, and an inner edge 158. The inner edge 158 of fourth taper portion 162 also may be the outer edge of third taper portion 152. The top edge 166 of fourth taper portion 162 may extend perpendicular to the long edge of spine portion 112 of inverted-F antenna element 108. In some embodiments, the top edge of fourth taper portion 162 may extend from inner edge 158 to outer edge 168 a distance 180 of substantially 30 millimeters. This distance corresponds to a distance 182 that projection 148 extends from bottom edge 146 of second taper portion 142 to top edge 170 of outermost sidewall 150 which is also substantially 30 millimeters. Said another way, the second taper portion 142 may be recessed from top edge 170 of outermost sidewall 150 by distance 182 of substantially 30 millimeters. This dimension may apply to implementations where the wireless antenna signal is in the 2.4 GHz frequency band. It will be appreciated that other dimensions may be formed in implementations where another signal frequency band is used.

The bottom edge 164 of fourth taper portion 152 may extend at an angle that is obtuse relative to the long edge of spine portion 112 of inverted-F antenna element 108. Further, top edge 166 and bottom edge 164 of fourth taper portion 162 may meet at outer edge 168. In some embodiments, the outer edge 168 may come to a point (or may span a short distance). The outer edge 168 may extend along a portion of a top edge 170 of outermost sidewall 150. The fourth taper portion 162 may slope away from a narrow face of PCB 110 such that bottom edge 164 is closer to the narrow face of PCB 110 than top edge 166 until bottom edge 164 and top edge 166 meet at outer edge 168. The slope of third taper portion 152 and the slope of fourth taper portion 162 may reduce or inhibit interference of wireless signals directed in a direction that is substantially aligned parallel to spine portion 112 of inverted-F antenna element 108 toward conductive enclosure 104.

The fifth taper portion 172 may be positioned vertically intermediate top surface 136 of conductive enclosure 104 and bottom edge 120 of first sidewall 118. The fifth taper portion 172 may include a bottom edge 174, a top edge 176, an inner edge 166 and an outer edge 178. The bottom edge 174 of fifth taper portion 172 may extend along a portion of top edge 170 of outermost sidewall 150. The top edge 176 of fifth taper portion 172 may extend along a portion of top surface 136. The inner edge 166 of fifth taper portion 172 also may be the top edge of fourth taper portion 162. The top edge 176 of fifth taper portion 172 may extend parallel to the long edge of spine portion 112 of inverted-F antenna element 108. The fifth taper portion 172 may be oriented such that it extends to outermost edge 124 of first sidewall 118 (or top edge 170 of outermost sidewall 150). The fifth taper portion 172 may slope up towards top surface 136 of conductive enclosure 104 such that bottom edge 174 is lower than top edge 176. The slope of fifth taper portion 152 may extend the bounds of void 116 to reduce or inhibit interference of wireless signals directed in a direction that is offset from inverted-F antenna element to an outermost edge region of conductive enclosure 104.

The void may be collectively bound by first taper portion 138, second taper portion 142, and projection 148 on two sides of wireless antenna 106. In other words, the first taper portion 138 may adjoin second taper portion 142, second taper portion 142 may adjoin third taper portion 152, third taper portion 152 may adjoin fourth taper portion 162, and fourth taper portion 162 may adjoin fifth taper portion 172 to collectively bound void 116 along two sides of wireless antenna 106 that correspond to first sidewall 118 and second sidewall 128 of conductive enclosure 104.

In some embodiments, each taper portion may have the same or similar angle of taper (or slope) such as angle 188 of second taper portion 142 and angle 190 of third taper portion 152. For example, an angle of taper of each of first taper portion 138, second taper portion 142, third taper portion 152, fourth taper portion 162, and fifth taper portion 172 may be in a range of 30-50 degrees as measured relative to the vertical axis. In other words, the angle of taper is the slope of the taper portion. This angle of taper range may produce signal reflections that increase signal strength more than angles of taper that are steeper or shallower than 30-50 degrees. More particularly, the angle of taper of each of first taper portion 138, second taper portion 142, third taper portion 152, fourth taper portion 162, and fifth taper portion 172 may be substantially 45 degrees to further increase signal strength. Note the above described angle ranges apply to implementations where the wireless antenna signal is in the 2.4 gigahertz (GHz) frequency band. Moreover, other angle ranges for the angle of taper (i.e. the slope) of the taper portions may differ for different wireless signal frequency bands.

In some embodiments, some taper portions may have different angles of taper. For example, some taper portions may have an angle of taper that is shallower than other taper portion in order to accommodate electronic components held within the conductive enclosure. In some cases one or more edges may not be tapered to accommodate electronic component constraints.

In the illustrated embodiment, each of second taper portion 142, third taper portion 152, fourth taper portion 162, and fifth taper portion 172 may have angle of taper of substantially 45 degrees. Correspondingly, bottom edge 146 of second taper portion 142, bottom edge 154 of third taper portion 152, bottom edge 164 of fourth taper portion 162, and bottom edge 174 of fifth taper portion 172 may be positioned at a location that is a distance 186 (shown in FIG. 2) that is substantially 9.5 millimeters below top surface 136 of conductive enclosure 104. The distance 186 may also correspond to a location substantially equal to or below a bottom of antenna element 108. In other words, in the illustrated embodiment, the bottom of the two branch portions of the inverted-F antenna element is positioned substantially not below a bottom edge of the first taper portion, the second taper portion, the third taper portion, the fourth taper portion, and the fifth taper portion. By extending the taper portions to at or below a bottom of the antenna element, a void may be created to reduce or inhibit signal interference. Moreover, by extending the taper portions to the bottom of the antenna element, more space may be made within the conductive enclosure to hold electronic components. It will be appreciated that the above described dimensions may apply to implementations where the wireless antenna signal is in the 2.4 GHz frequency band. It will be appreciated that other dimensions may be formed in implementations where another signal frequency band is used.

FIG. 2 is a left side view of the conductive enclosure wireless antenna interface of FIG. 1. Note that FIG. 2 is not drawn to scale. As discussed above, void 116 may be bound by at least one taper portion (e.g., first taper portion, second taper portion, third taper portion, fourth taper portion, fifth taper portion) positioned vertically intermediate top surface 136 of conductive enclosure 104 and the bottom edge 120 of first sidewall 118. The wireless antenna 106 may be coupled to conductive enclosure 104 to position inverted-F antenna element 108 proximate void 116. In particular, the bottom of the two branch portions 114 of inverted-F antenna element 108 may be positioned substantially not below the bottom edge of at least one taper portion (e.g., first taper portion, second taper portion, third taper portion, fourth taper portion, fifth taper portion). Said another way, the bottom of the two branch portions 114 of the inverted-F antenna element 108 may be positioned at or above top edge 122 of first sidewall 118. By positioning the antenna element proximate the void and/or above the sidewalls of the conductive enclosure, the wireless antenna may be permitted to send/receive signals with reduced interference from the conductive enclosure.

Furthermore, the wireless antenna 106 may be coupled to conductive enclosure 104 such that the conductive enclosure does not extend under the bottom of the wireless antenna. As such, the void may include the area under the bottom of the wireless antenna. The region of the void may allow for increased signal strength in the area below the wireless antenna. Further, the bounds of void 116 may vary based on a distance between the wireless antenna 106 and first sidewall 118 as well as the position of the antenna element in the wireless antenna. For example, the coupling may be extended to increase the size of the void between the wireless antenna and the first sidewall which may cause an increase in signal strength. In some embodiments, the distance between the wireless antenna and the sidewall may be very small to accommodate electronic device housing constraints. The void and/or taper portions may enable the wireless antenna to be located closer to the conductive enclosure while maintaining suitable wireless signal strength than would be possible in an implementation in which the conductive enclosure does not include a void and/or taper portions. Accordingly, the size of the electronic device housing may be reduced and/or may be made more streamlined.

FIG. 3 is a partial perspective view of another embodiment of a conductive enclosure wireless antenna interface 302 of a wireless communication enabled electronic device of the present disclosure. In this embodiment, a wireless antenna 306 including an antenna element 308 may be coupled to a conductive enclosure 304 such that a void 316 is formed on at least one side of the antenna element. The void 316 may be bound by at least one taper portion 338 positioned vertically intermediate a top surface of the conductive enclosure and a bottom edge of the sidewall.

In some embodiments, the void may be bound on a plurality of sides of the antenna element. In particular, the void may be optionally bound on additional sides by sidewalls and/or taper elements as indicated by the double-dot dashed lines. In some embodiments, the void may be formed on at least two, three, or four sides of the wireless antenna by sidewalls and/or tapered portions. For example, a void may be formed on two sides of the antenna element by first taper portion 336 and a second taper portion 342. As another example, a void may be formed on three sides of the antenna element by first taper portion 336, second taper portion 342, and a third taper portion 352. As yet another example, a void may be formed on four sides of the antenna element by first taper portion 336, second taper portion 342, a third taper portion 352, and a fourth taper portion 362. In some embodiments where taper portions on opposing sides of the antenna element form a void, the opposing taper portions may mirror each other in shape so that complimentary signal reflections occur to improve signal strength of the wireless antenna.

Figure 5:
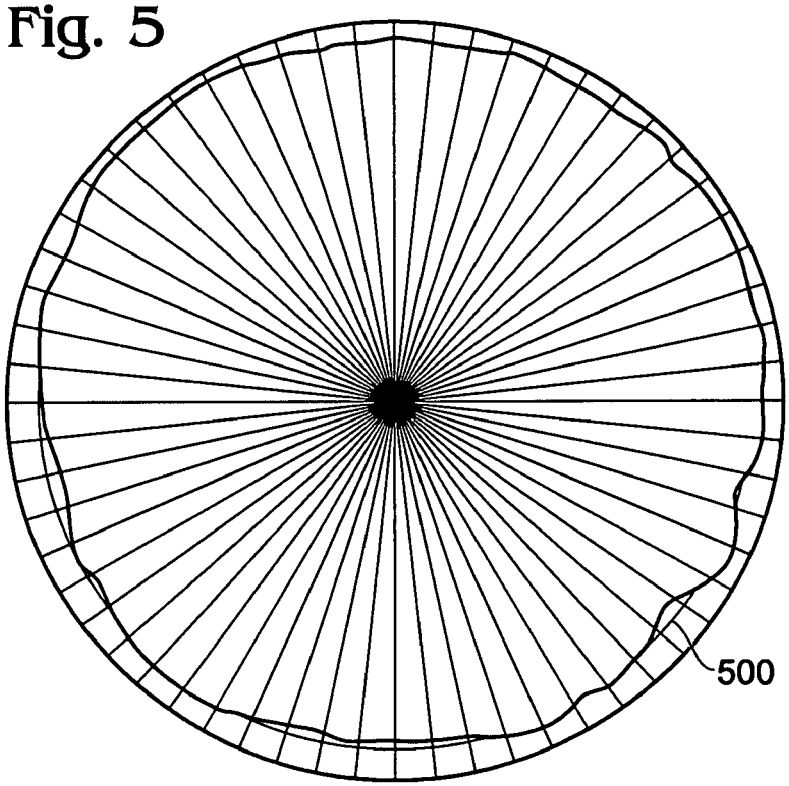
FIG. 5 is a 360 degree signal graph of a wireless communication enabled electronic device that includes a conductive enclosure with taper portions.

FIG. 4 is a 360 degree signal graph of a wireless communication enabled electronic device that includes a conductive enclosure without taper portions and FIG. 5 is a 360 degree signal graph of a wireless communication enabled electronic device that includes a conductive enclosure with taper portions. The signal graphs plots are generated at a predetermined 2D plane through the 3D shape (and through the wireless antenna element) of the electronic device. In particular, the 3D signal pattern of the antenna may be shaped as a toroid, and the 2D plots in FIGS. 4 and 5 show slices that laterally bisect the toroid. As such, the 2D slice has a circular parameter. Note signal data may vary as the 2D plane at which signal strength is measured is varied. As can be seen in FIG. 4, the antenna pattern of the conductive enclosure without the taper portions has signal nulls at various angles 402, 404, and 406, among others surrounding the wireless antenna. This is because the conductive enclosure without the taper portions blocks the signal in certain directions corresponding to the various angles which causes the nulls in the pattern. In addition, the signal reflections from the un-tapered edges tend to add destructively which leads to overall lower signal level, such as level 400. In contrast, as shown in FIG. 5, the antenna pattern of the conductive enclosure that forms a void around the wireless antenna with tapered edges exhibits uniform antenna pattern and an overall signal level 500 that is higher than that of the lower signal level 400 of the conductive enclosure without taper portions. As a result, devices constructed according to the above-described embodiments may wirelessly communicate more stably and with increased fidelity as compared to prior devices, thereby enhancing the user experience.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A wireless communication enabled electronic device, comprising:

a wireless antenna including an antenna element; and a conductive enclosure configured to inhibit electrical interference, the conductive enclosure being coupled to the wireless antenna such that a void facilitating transmission of electrical signals is formed on at least one side of the antenna element, the void being bound by:

a sidewall of the conductive enclosure having a bottom edge; and at least one taper portion of the conductive enclosure positioned vertically intermediate a top surface of the conductive enclosure and the bottom edge of the sidewall, the top surface of the conductive enclosure extending vertically to, but not beyond, a top region of the wireless antenna.

2. The device of claim 1, wherein a top edge of the at least one taper portion extends parallel to a long edge of the antenna element.

3. The device of claim 2, wherein the at least one taper portion extends to an outermost edge of the sidewall.

4. The device of claim 1, wherein a top edge of the at least one taper portion extends perpendicular to a long edge of the antenna element.

5. The device of claim 4, wherein a bottom edge of the at least one taper portion extends at an angle that is obtuse relative to the long edge of the antenna element.

6. The device of claim 1, wherein a top edge of the at least one taper portion extends parallel to a long edge of the antenna element, and the at least one taper portion extends substantially along a length of the long edge of the antenna element.

7. The device of claim 1, wherein the sidewall is a first sidewall, and wherein the at least one taper portion includes:

a first taper portion positioned vertically intermediate the top surface of the conductive enclosure and a bottom edge of a second sidewall positioned perpendicular to the first sidewall, the first taper portion having a top edge that extends parallel to a long edge of the antenna element, and the first taper portion extending substantially along a length of the long edge of the antenna element; and a second taper portion that extends perpendicular to a top edge of the first sidewall and parallel to a long edge of the antenna element.

8. The device of claim 7 further comprising:

a projection that extends laterally from the second taper portion to an outermost edge of first the sidewall, the projection including:

a third taper portion including a top edge that extends perpendicular to the long edge of the antenna element, a fourth taper portion including a top edge and a bottom edge, the top edge extending perpendicular to the long edge of the antenna element and the bottom edge extending at an angle that is obtuse relative to the long edge of the antenna element, and a fifth taper portion including a top edge and a bottom edge, the top edge extending parallel to the long edge of the antenna element and the bottom edge being part of the outermost edge of the first sidewall;

wherein the first taper portion adjoins the second taper portion, the second taper portion adjoins the third taper portion, the third taper portion adjoins the fourth taper portion, and the fourth taper portion adjoins the fifth taper portion to bind the void.

9. The device of claim 1, wherein the antenna element is a planar antenna element.

10. The device of claim 1, wherein a bottom of the antenna element is positioned substantially not below a bottom edge of the at least one taper portion.

11. The device of claim 1, wherein the void is formed on at least two sides of the wireless antenna.

12. The device of claim 1, wherein an angle of taper of the at least one taper portion is in a range of 30-50 degrees.

13. A wireless communication enabled electronic device, comprising:

a wireless antenna including an antenna element; and a conductive enclosure configured to inhibit electrical interference, the conductive enclosure being coupled to the wireless antenna such that a void is formed on at least one side of the antenna element, the void being bound by:

a first sidewall;

a second sidewall positioned perpendicularly adjacent the first sidewall, the second sidewall having a bottom edge;

a first taper portion positioned vertically intermediate a top surface of the conductive enclosure and the bottom edge of the second sidewall, the first taper portion having a top edge that extends parallel to a long edge of the antenna element, and the first taper portion extending substantially along a length of the long edge of the antenna element;

a second taper portion that extends perpendicular to a top edge of the first sidewall and parallel to the long edge of the antenna element; and a projection that extends laterally from the second taper portion to an outermost edge of the first sidewall, the projection including: a third taper portion that adjoins a fourth taper portion, and a fifth taper portion that adjoins the fourth taper portion, each of the third taper portion, the fourth taper portion, and the fifth taper portion sloping in a different direction.

14. The device of claim 13, wherein the third taper portion includes a top edge that extends perpendicular to the long edge of the antenna element, wherein the fourth taper portion includes a top edge and a bottom edge, the top edge extends perpendicular to the long edge of the antenna element and the bottom edge extends at an angle that is obtuse relative to the long edge of the antenna element, and wherein the fifth taper portion includes a top edge and a bottom edge, the top edge extends parallel to the long edge of the antenna element and the bottom edge is part of the outermost edge of the first sidewall.

15. The device of claim 13, wherein the antenna element is a planar antenna element.

16. The device of claim 15, wherein the planar antenna element is selected from the group consisting of an inverted-F antenna element, a monopole antenna element, and a chip antenna element.

17. The device of claim 13, wherein a bottom of the antenna element is positioned substantially not below a bottom edge of the first taper portion, the second taper portion, the third taper portion, the fourth taper portion, and the fifth taper portion.

18. The device of claim 13, wherein an angle of taper of each of the first taper portion, the second taper portion, the third taper portion, the fourth taper portion, and the fifth taper portion is in a range of 30-50 degrees.

19. A wireless communication enabled electronic device, comprising:

a wireless antenna including a planar antenna element; and a conductive enclosure configured to inhibit electrical interference, the conductive enclosure being coupled to the wireless antenna such that a void is formed on at least two sides of the wireless antenna, the void being bound by:

a first sidewall;

a second sidewall positioned perpendicularly adjacent the first sidewall, the second sidewall having a bottom edge;

a first taper portion positioned vertically intermediate a top surface of the conductive enclosure and the bottom edge of the second sidewall, the first taper portion having a top edge that extends substantially a length of the planar antenna element aligned in parallel with a plane of the planar antenna element;

a second taper portion that extends perpendicularly from a top edge of the first sidewall and parallel to the plane of the planar antenna element; and a projection that extends laterally from a bottom edge of the second taper portion to an outermost edge of the first sidewall, the projection including:

a third taper portion including a top edge that extends perpendicular to the plane of the planar antenna element, a fourth taper portion including a top edge and a bottom edge, the top edge extending perpendicular to the plane of the planar antenna element and the bottom edge extending at an angle that is obtuse relative to the plane of the planar antenna element, and a fifth taper portion including a top edge and a bottom edge, the top edge extending parallel to the plane of the planar antenna element and the bottom edge being part of the outermost edge of the first sidewall;

wherein the first taper portion adjoins the second taper portion, the second taper portion adjoins the third taper portion, the third taper portion adjoins the fourth taper portion, and the fourth taper portion adjoins the fifth taper portion to bind the void.

20. The device of claim 19, wherein a bottom of the planar antenna element is positioned substantially not below a bottom edge of any of the first taper portion, the second taper portion, the third taper portion, the fourth taper portion, and the fifth taper portion.

* * * * *